US006508727B1

(12) United States Patent
Su

(10) Patent No.: US 6,508,727 B1
(45) Date of Patent: Jan. 21, 2003

(54) METHOD FOR MAKING A BAMBOO-MADE GOLF TEE

(76) Inventor: Charles Su, No. 37-4, Au-Tsu Chiao, Ta-Keh Tsun, Tung-Shan Hsiang, Tainan Hsien (TW)

( * ) Notice: Subject to any disclaimer, the term of this patent is extended or adjusted under 35 U.S.C. 154(b) by 0 days.

(21) Appl. No.: 09/962,302

(22) Filed: Sep. 26, 2001

(51) Int. Cl.[7] ..... A63B 57/00
(52) U.S. Cl. ..... 473/387; 473/399
(58) Field of Search ..... 473/387–403

(56) References Cited

U.S. PATENT DOCUMENTS 1,542,505 A * 6/1925 Jacobus ..... 473/401
1,588,038 A * 6/1926 Miller ..... 473/401
1,614,343 A * 1/1927 Broome ..... 473/399
D85,229 S * 9/1931 Cannon, Jr. ..... 473/402
1,981,810 A * 11/1934 Parkhurst ..... 473/402

* cited by examiner

*Primary Examiner*—Steven Wong
(74) *Attorney, Agent, or Firm*—Jones, Tullar & Cooper, P.C.

(57) ABSTRACT

A method for making a bamboo made golf tee has the steps of preparing an elongated rod, preparing a cylinder, trimming one end of the elongated rod to make the elongated rod have a sharpened end, trimming a periphery of the cylinder to make the cylinder to have a tapered end, defining a central hole in the cylinder and securely attaching the other end of the elongated rod in the central hole.

1 Claim, 2 Drawing Sheets

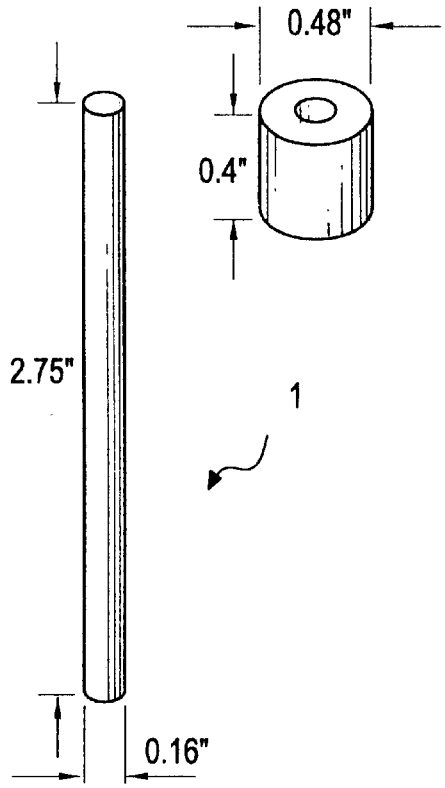
FIG.4
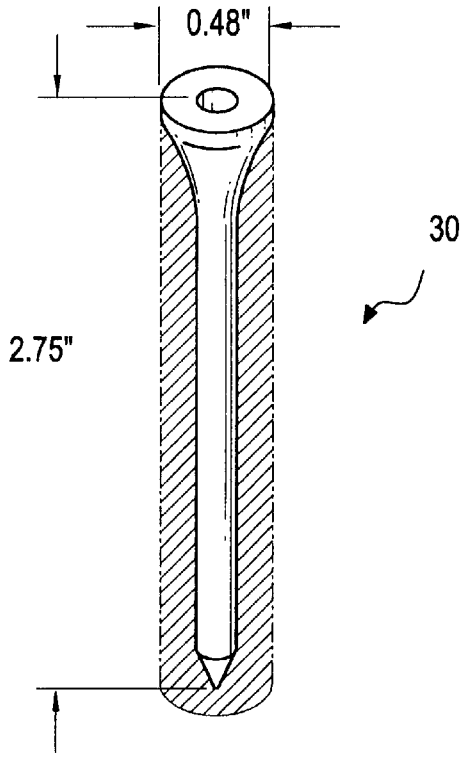

METHOD FOR MAKING A BAMBOO-MADE GOLF TEE

BACKGROUND OF THE INVENTION

1. Field of the Invention

The present invention relates to method for making a golf tee, and more particularly to the method of making a golf tee that uses the bamboo as the raw material and uses the least amount of material and the product thereof is biodegradable.

2. Description of Related Art

The conventional method of making a golf tee uses a single piece of wood and removes the excess wood to make an integral golf tee. With reference to FIG. 5, an embodiment of the conventional method is shown. After a cylindrical piece of wood (30) is prepared, the excess wood (31) (the shaded portion) is removed to leave an integral tee, which wastes a lot of material. Furthermore, the tee made by the conventional method usually is made of wood. Because the conventional wooden tee often suffers from insects, most of the wooden tees have wormholes. In order to cover the ugly appearance made by the wormholes, colorful paint is implemented so that not only the user is able to find the wooden tees in the grass, but also the ugly appearance from the wormholes are covered. However, after the wooden tees are painted with colorful paint and are disposed on the grass, the paint fumes and thus produces pollution to the environment. Still, a wood tree normally needs 15–20 years before it can be harvested as the raw material of wooden tee, which means when a cut of wooden trees is made, we have to wait for another 15–20 years to have the second harvest, which is a great damage to the earth environment.

To overcome the shortcomings, the present invention tends to provide an improved method to mitigate and obviate the aforementioned problems.

SUMMARY OF THE INVENTION

The primary objective of the invention is to provide a method for making a bamboo made golf tee, which includes the following steps:

preparing an elongated rod and a cylinder of bamboo;

trimming one end of the elongated rod and a periphery of the cylinder defining a central hole in the cylinder; and securely attaching the opposite end of the elongated rod from the trimmed end in the central hole.

Other objects, advantages and novel features of the invention will become more apparent from the following detailed description when taken in conjunction with the accompanying drawings.

BRIEF DESCRIPTION OF THE DRAWINGS

FIG. 4 is a plan view showing the dimensional differences of the bamboo tee and the wooden tee;

DETAILED DESCRIPTION OF THE PREFERRED EMBODIMENT

In order to preserve the environment and the natural resources, the present invention adopts the material of bamboo to make the golf tee. Because the growing period of a bamboo from baby to adult and big and good enough for harvest is only 6 months and a mother bamboo tree can grow 7–10 baby bamboo trees in a year naturally, user is able to have the plentiful material ready within a very short period of time without damaging the earth environment. Furthermore, bamboo does not suffer from insects, so that the user is able to use the original color of bamboo without using the environment hostile material (paint) to cover the wormholes. Therefore, even after the bamboo-made tee is abandoned in the grass, the bamboo-made tee is able to decompose naturally and without any pollution.

Figure 1:
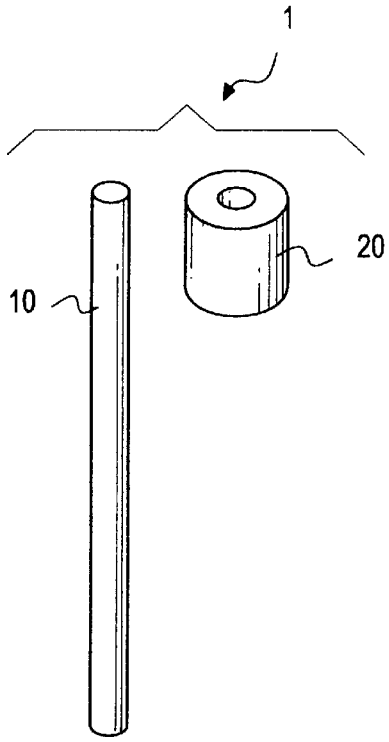
FIG. 1 is an exploded perspective view of the first step of the method for making a golf tee in accordance with the present invention.
Figure 2:
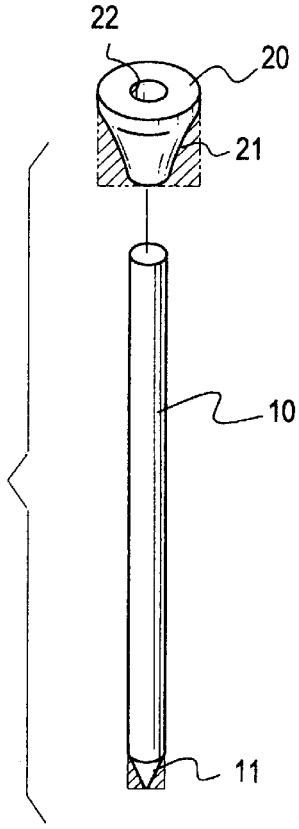
FIG. 2 is an exploded perspective view of the second step of the method for making a golf tee in accordance with the present invention.
Figure 3:
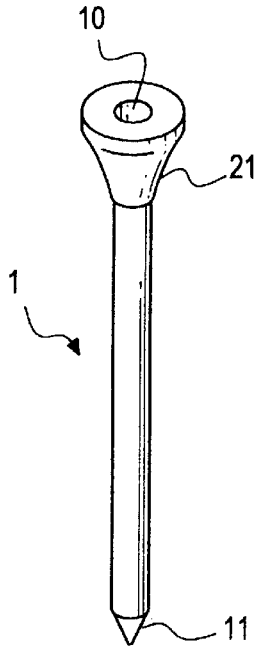
FIG. 3 is a perspective view of the golf tee constructed in accordance with the method for making a golf tee in accordance with the present invention.
Figure 5:
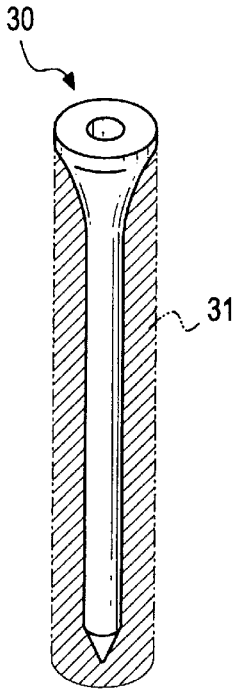
FIG.5 PRIOR ART
FIG. 5 is a perspective view of a conventional golf tee constructed in accordance with the conventional method.

With reference to FIGS. 1, 2 and 3, the method for making a bamboo golf tee (1) in accordance with the present invention has the steps of:

preparing an elongated rod (10);

preparing a cylinder (20);

trimming one end of the elongated rod (10) to make the elongated rod (10) have a sharpened end (11);

trimming a periphery of the cylinder (20) to make the cylinder (20) have a tapered end (21);

defining a central hole (22) in the cylinder (20); and securely attaching the opposite end of the elongated rod (10) from the sharpened end (11) in the central hole (22).

When considering the material consumption rate between the conventional golf tee and the golf tee of the present invention, a formula $\pi r^2 \times h$ is used, wherein r stands for the radius of the head of the tee and h stands for the height of the tee. Accordingly, with reference to FIG. 4:

Conventional material consumption rate: $\pi r^2 \times h = 3.14\ (0.24)^2 \times 2.75 = 0.479\ (\text{inch}^3)$ Material consumption rate of the invention: $\pi r^2 \times h = [3.14\ (0.24)^2 \times h' = 3.14 \times 0.24^2 \times 0.4 = 0.072] + [3.14 \times (0.08)^2 \times h''] = 3.14 \times 0.08^2 \times 2.75 = 0.055\ 0.072 + 0.055 = 0.127\ (\text{inch}^3)$ wherein h' is the height of the head and h" is the height of the body of the tee.

Ratio between the invention and the conventional art is 0.172/0.497=25.6%

The material used in the method for making a golf tee (1) in accordance with the present invention is less than 26 percent of the material used with the conventional method. Further, most conventional golf tees must be painted to cover the wormholes in the wood, which produces environmental pollution. Because the paint on the surface of the conventional golf tee makes the golf tee non-biodegradable, bamboo is used as the material in the present invention. Because insects cause almost no bite to bamboo, bamboo does not have wormholes and no paint is needed. Thus the golf tee is biodegradable, and after the golf tee is used, it is abandoned in the grass.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a golf tee, the method comprising the acts of:

preparing an elongated rod of bamboo;

preparing a cylinder of bamboo;

trimming one end of the elongated rod to make the elongated rod have a sharpened end;

trimming a periphery of the cylinder to make the cylinder to have a tapered end;

defining a central hole in the cylinder; and securely attaching the opposite end of the elongated rod from the sharpened end in the central hole.

* * * * *